United States Patent [19]

Walker

[11] 3,939,810

[45] Feb. 24, 1976

[54] ENGINE SPEED RESPONSIVE MEANS FOR CHANGING THE POSITION OF A VACUUM SPARK ADVANCE LIMITER STOP

[76] Inventor: Brooks Walker, 1280 Columbus Ave., San Francisco, Calif. 94133

[22] Filed: Apr. 12, 1974

[21] Appl. No.: 460,541

[52] U.S. Cl. ..... 123/117 A; 123/146.5 A

[51] Int. Cl.[2] ..... F02P 5/04

[58] Field of Search ..... 123/117 A, 117 R, 146.5 A

[56] References Cited

UNITED STATES PATENTS

| | | | |
|---|---|---|---|
| 2,384,693 | 9/1945 | Olson | 123/117 A |
| 2,731,532 | 1/1956 | Downing | 123/117 A |
| 2,809,620 | 10/1957 | Boylan | 123/117 A |
| 3,272,191 | 9/1966 | Walker | 123/117 A |
| 3,452,728 | 7/1969 | Salomon | 123/117 A |
| 3,479,998 | 11/1969 | Walker | 123/117 A |
| 3,581,852 | 6/1971 | Griffen | 123/117 A |
| 3,603,298 | 9/1971 | Toda | 123/117 A |
| 3,885,535 | 5/1975 | Walker | 123/117 A |

FOREIGN PATENTS OR APPLICATIONS

| | | | |
|---|---|---|---|
| 214,574 | 3/1957 | Australia | 123/146.5 A |

*Primary Examiner*—Wendell E. Burns
*Assistant Examiner*—Paul Devinsky
*Attorney, Agent, or Firm*—Owen, Wickersham & Erickson

[57] ABSTRACT

A stop limits movement of a vacuum spark advance motor operating element connected to the distributor breaker plate, and the position of the stop is changed in response to selected changes in engine or vehicle speed.

7 Claims, 8 Drawing Figures

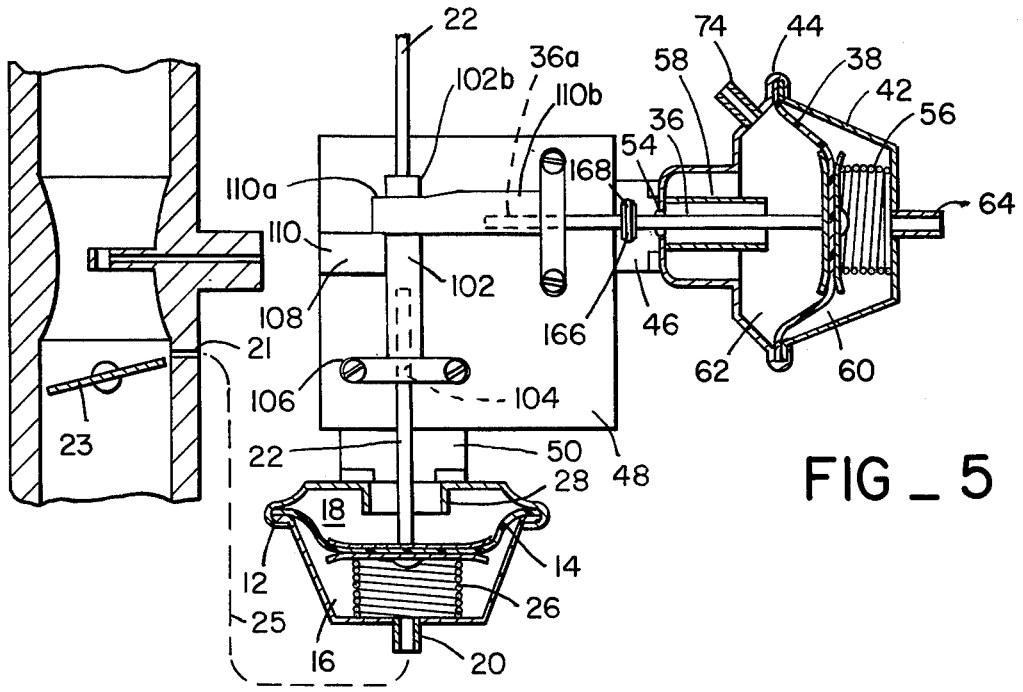
FIG_5
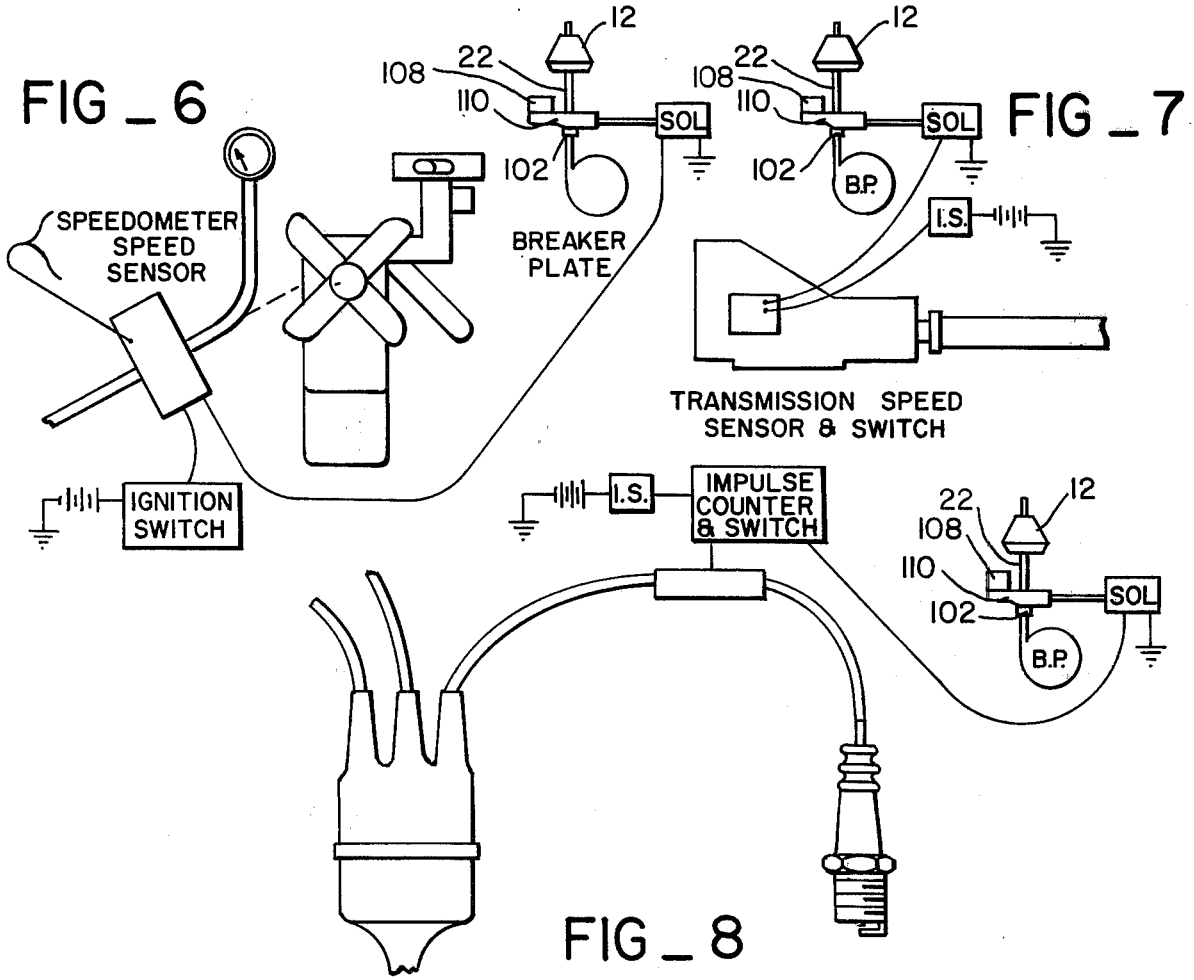
FIG_6
FIG_7
FIG_8

ENGINE SPEED RESPONSIVE MEANS FOR CHANGING THE POSITION OF A VACUUM SPARK ADVANCE LIMITER STOP

BACKGROUND OF THE INVENTION

This invention relates to a series of devices that can be easily applied to conventional vacuum spark advance (V.S.A.) motors of existing cars or new cars to limit the vacuum spark advance normally produced by engine intake suctions under certain driving conditions. It relates particularly to a device which changes a limit on the movement of the V.S.A. motor operating element in response to changes in engine speed. It can be adjusted to be responsive to different engine speeds corresponding to different speed limits imposed by authorities.

The conventional vacuum spark advance motors of most existing cars normally produce about one-half inch of travel at high intake suction, such as more than 12 to 15 inches of mercury (Hg) below atmosphere. This amount of travel may amount to about 15° spark advance (more than the governor spark advance at many engine speeds).

This amount of spark advance at high intake suction (such as may be produced at level cruise at 50–70 m.p.h.), produces high combustion temperatures in the engine cylinders and improved mileage. However, high combustion temperatures tend to increase the amount of nitrous oxides ($NO_x$) and therefore contribute undesirable exhaust emissions.

In an attempt to remedy this problem of undesirable $NO_x$ emissions, the prior art has disconnected the vacuum spark advance at all engine speeds or below a selected engine or road speed. However, such disconnection substantially reduces the engine efficiency and fuel economy.

Recent reports indicate that $NO_x$ is not as important a source of pollutant as was previously thought. Fuel consumption is becoming more important because of the present and the projected future fuel shortage and the adverse effect of foreign oil purchases on our balance of trade.

CROSS REFERENCE TO RELATED APPLICATION

My prior U.S. application Ser. No. 396,235, filed Sept. 11, 1973, and entitled "Retrofit Adapter to Limit Travel of Vacuum Spark Advance Motors" discloses a retrofit adapter constructed so as to be easily installed on conventional V.S.A. motors of existing cars to reduce the maximum amount of vacuum spark advance that is normally produced by engine intake suction. This application Ser. No. 396,235 discloses a stop arrangement in which the vacuum spark advance is limited to a maximum amount by a stop which is installed in a fixed position with respect to the operating mechanism of the V.S.A. motor.

The present invention is an improvement over that disclosed in my prior application Ser. No. 396,235 because the limit on the movement of the V.S.A motor operating element is changed in response to changes in engine speed, to allow more V.S.A. at and near the highway cruise speed for better mileage and still less than full V.S.A. as was used on some production automobile engines.

SUMMARY OF THE INVENTION

It is a primary object of the present invention to construct a series of devices that can be easily applied to conventional V.S.A motors of existing cars both to limit the movement of the V.S.A. operating element to an amount less than the normal maximum movement and to change the limit on the movement in response to changes in engine speed.

It is a related object to construct a variable stop that will provide less restriction on the normal V.S.A. spark advance at higher engine speeds than at lower engine speeds.

In a specific embodiment of the present invention a mechanical stop limits the movement of the V.S.A. operating element connected to the electrical interrupter mechanism (e.g. the distributor breaker plate for a point ignition system or the stator of an electronic ignition system) that controls some of the timing of the ignition advance or retard. The stop is held at a first position at all speeds below a selected engine speed (e.g. 55 m.p.h.) to permit only a relatively small ignition advance (e.g. 6°). A diaphragm actuated motor powered by the pressure differential between the inlet and a pitot tube near the perimeter at the pump rotor of the water pump shifts the stop to a second position in response to an increase in engine speed above the selected speed. In the second position the stop permits a greater ignition advance (e.g. 11°) but still limits the advance to less than the normal advance that would be produced by high intake suctions.

The speed sensing technique using the engine cooling liquid pump is similar to the speed sensing technique disclosed in my prior U.S. Pat. No. 3,204,620 issued Sept. 7, 1965 and entitled "SPEED SENSING DEVICE."

Travel limiting apparatus and methods for a V.S.A. motor which incorporate the structure and techniques described above and which are effective to function as described above constitute specific objects of this invention.

Other objects, advantages and features of my invention will become apparent from the following detailed description of one preferred embodiment taken with the accompanying drawings.

BRIEF DESCRIPTION OF THE DRAWINGS

In the drawings:

FIG. 1 shows the limiter device and the component parts in the positions assumed when the motor is running at idle;

FIG. 1 illustrates the positions of the parts at idle, allowing limited V.S.A.;

FIG. 5 is a view like FIG. 4 showing the positions of the parts at speeds over a selected speed such as 45 m.p.h., allowing more V.S.A.;

FIGS. 6, 7 and 8 are schematic views showing how the engine speed can be sensed from the speedometer cable (FIG. 6), the engine transmission (FIG. 7) or the engine ignition system (FIG. 8).

DESCRIPTION OF THE PREFERRED EMBODIMENTS

In all figures like numerals of reference refer to corresponding parts.

Figure 1:
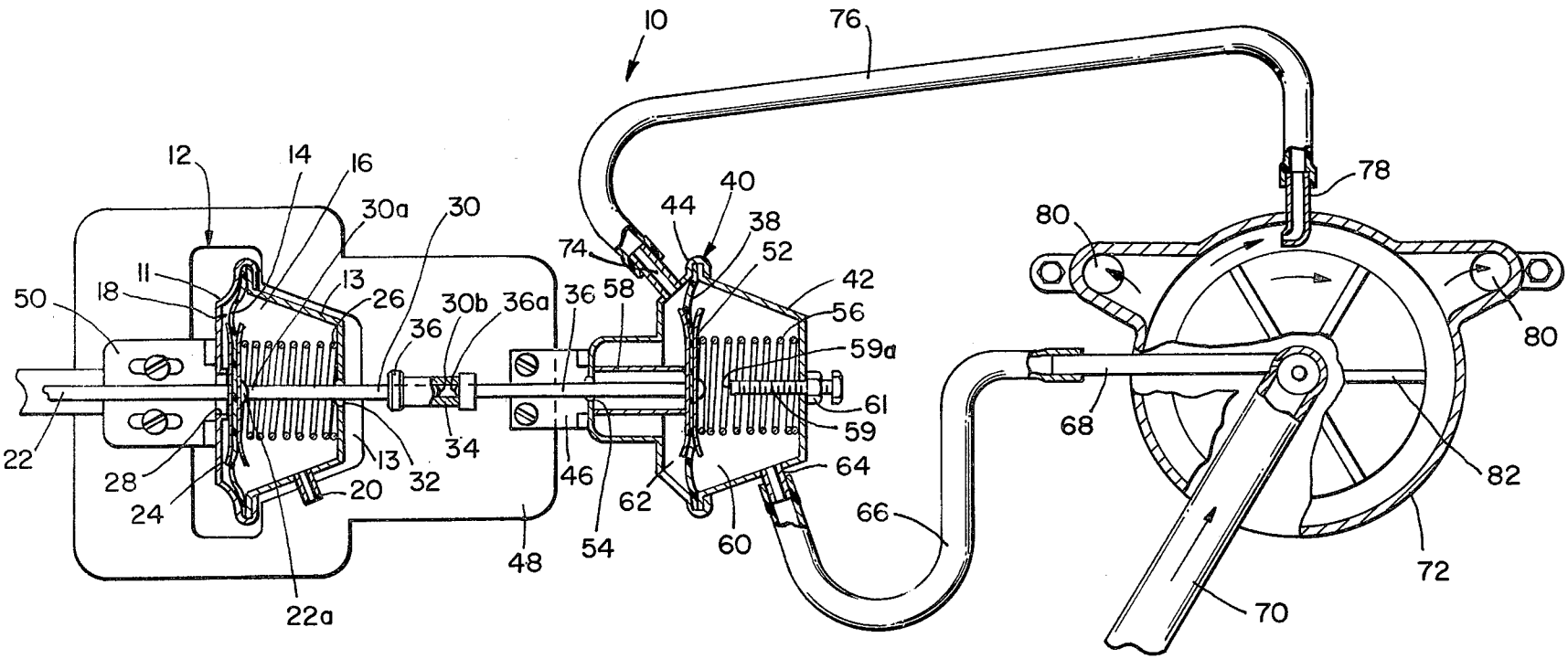
FIG. 1 is a schematic plan view, mostly in cross section, showing a speed responsive V.S.A. limiter device constructed in accordance with one embodiment of the present invention.

In FIG. 1 a speed responsive V.S.A. limiter device constructed in accordance with one embodiment of the present invention is indicated generally by the reference numeral 10.

Where I use vacuum herein I mean a partial vacuum as generally used in the industry to describe the differential pressure on the diaphragm of the motor which controls a portion of the advance and retard of the ignition (as opposed to the governor advance of the rotor) whether the plate that is controlled controls the pivot of the breaker points in a point ignition system or the motion of the stator in an electronic ignition system, both of which are well known in the industry.

The suction available to the motor is generally developed in the intake manifold but may be controlled or limited by valve means such as the high port on the upstream of the butterfly commonly used on many engines or other appropriate valve means.

The device 10 is associated with a V.S.A. motor 12. The motor 12 has two sections 11 and 13 joined at their peripheries to form an outer housing. A flexible diaphragm 14 extends across the interior of the housing to provide a first chamber 16 and a second chamber 18.

The chamber 16 is connected to the high port 21 (see FIG. 5) of the engine carburetor by a fitting 20 and tube 25.

The high port is the port above the upstream upper edge of the throttle butterfly 23 in the engine carburetor 9 as illustrated in FIG. 5. The chamber 18 is connected to ambient atmospheric pressure through an opening illustrated around operating element 22 in FIG. 1.

An operating element 22 is connected at one end to the diaphragm 14 by a pair of metal washers 24. The other end of the operating element 22 is connected to the movable breaker plate of the distributor in the usual manner as in the usual practice but not shown.

A biasing spring 26 biases the arm 22 outwardly of the V.S.A. motor housing (leftwardly as viewed in FIG. 1), and a sleeve 28 limits this outward movement of the operating arm 22 towards V.S.A. retard.

In the operation of the V.S.A. motor 12 thus far described, increasing engine suction at the high port lowers the pressure within the chamber 16 relative to atmospheric pressure so that ambient atmospheric pressure operating on the chamber 18 side of the flexible diaphragm 14 moves the diaphragm and washers 24, against the force of the biasing spring 26, to retract the operating arm 22 within the V.S.A. motor housing. This rotates the breaker plate of the distributor to increase the spark advance by an amount depending upon the suction at the high port so that V.S.A. may start at about 6 inches Hg below atmosphere and be full V.S.A. at about 10–12 inches Hg below atmosphere; at and near wide open throttle there is normally no V.S.A. only the distributor governor advance not shown but usually used, as is well known in the art.

At high intake suctions, such as more than 12–15 inches Hg below atmosphere, the conventional vacuum spark advance motors of most existing cars normally produce about one-half inch of linear travel of the operating arm 22. This corresponds to about 15° V.S.A. of the breaker plate of the distributor.

The present invention includes a movable stop (in the form of the rods 30 and 36 in the FIG. 1 embodiment) for limiting the retraction of the operating arm 22 to an amount which is controlled by the engine speed.

The rod 30 is slidable back and forth within a sealed opening 32 in the part 13 of the motor housing 12. The inner end **30*a* abuts against the clamping head 22*a* of the rod 22 to limit retraction of the rod 22 within the motor housing 12** during certain conditions of engine operation, as will be described in more detail below.

A sleeve 34 is threaded on the other end **30*b* of the rod 30, and a locking nut 36 locks the sleeve 34** in an adjusted position.

One end **36*a* of the rod 36 is mounted for reciprocation within the end of the sleeve 34 opposite that engaged with the locking nut 36.**

The position of this rod 36 is determined by engine speed, as sensed by the liquid pressure on each side of a diaphragm 38 of a motor 40 as resisted by spring 56, as will be described herein.

The motor 40 comprises an outer housing made up of two housing members 42 and 44, and the housing is mounted by a mounting plate 46 to the same baseplate 48 to which the motor 12 is mounted by mounting plate 50.

The position of the motor housing 40 is thus fixed with respect to the motor housing 12.

The outside periphery of the diaphragm 38 is clamped between the two housing sections 42 and 44, and the central section of the diaphragm 38 is clamped between two washers 52. The washers 52 are in turn connected to the rod 36, as indicated above.

The rod 36 is reciprocable within a sealed opening 54 in the housing section 44.

A biasing spring 56 biases the diaphragm washers 52 and rod 36 outward and into engagement with the sleeve 58. The sleeve 58 acts as a fixed stop for determining the position of the rod 36 when the engine is not running or running below a selected engine speed.

The inward movement of the rod 36 within the housing 40 is limited by adjustable stop 59 which may be locked in an adjusted position by a locking nut 61.

The diaphragm 38 divides the interior of the housing 40 into two chambers 60 and 62. The chamber 60 is connected, by a fitting 64 and a line 66, to a probe 58 which senses the static pressure in an inlet conduit 70 of a water pump 72.

The chamber 62 is connected, by a fitting 74 and a conduit 76, to a probe 78 which picks up the velocity of impact of liquid following the perimeter of the impeller on the pitot opening in fitting 78 of the engine water pump 72. As illustrated in FIG. 1, the water pump 72 is a centrifugal type pump having generally radially extending impeller blades 82 as described in my said issued U.S. Pat. No. 3,204,620, issued Sept. 7, 1965.

The purpose of the speed responsive limiter device 10 is to restrict the normal vacuum spark advance a greater amount at low engine speeds than at high engine speeds. Thus, the device permits a greater amount of ignition advance at high suctions at high engine speeds than at high intake suctions at low engine speeds because the problem of nitrous oxide formation at the high engine speed is not as great as that at low engine speed and to improve mileage per gallon of fuel.

The device 10 permits a specific set of engine operation specifications to be met because of the adjustments provided and the mode of operation of the structure described above.

In the operation of the device 10, the difference between the total pressure sensed by the pitot opening facing the flow at the perimeter at the impeller of the probe 78 of the water pump and the static pressure sensed by the probe 68 at the intake to the engine water pump provides an accurate indication of the engine speed. Having the two pressures on the opposite sides of the diaphragm compensates for the pressure build up in the cooling liquid due to a pressure radiator cap. This pressure differential, when applied across the diaphragm 38, positions the end 36*a* of the rod 36 with respect to the facing end 30*b* of the rod 30 to determine both the point in the engine operation at which the rod 30 is effective to start limiting the movement of the arm 22 connected to the distributor breaker plate and also the amount of movement which is permitted at a selected particular engine speed after the rod 30 is engaged with the rod 22.

In a specific embodiment of the present invention illustrated in FIGS. 1, 2 and 3, the device 10 is constructed to allow the ignition to advance about 6° at speeds below 45 m.p.h. and 11° above 45 m.p.h., assuming a normal 15° V.S.A. with no stops. Adjustments to other advances and other engine speed limits are also possible to meet different engineering requirements or emission and mileage limits or different speed limits.

In FIG. 1, the parts are shown in the positions assumed with the motor running at idle or low speeds. In this condition of operation the pressure differential across the diaphragm 38 is not sufficient to move the washers 52 off the sleeve 58, and the end 36*a* is spaced about three-sixteenths inch from the end 30*b* within the sleeve 34. In this condition of operation the sleeve 34 is freely slidable over the end 36*a* of the rod 36 and therefore offers no restriction to any slight inward retraction of the operating arm 22 and arm 30 within the housing 13 as may occur during engine low cruise speed operations below the selected speed such as 45 m.p.h. above which arm 30 will be retracted toward spring 56.

Figure 2:
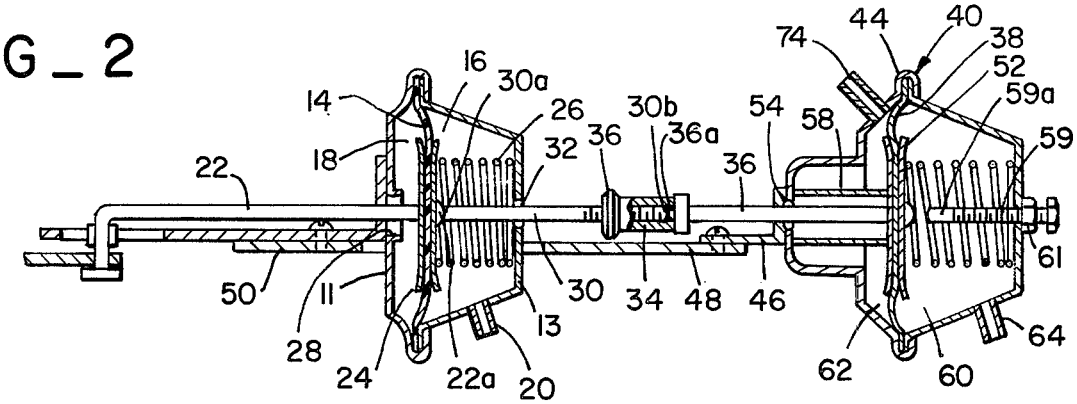
FIG. 2 is a view like FIG. 1 showing the limiter device and the parts in the positions assumed at speeds up to a selected speed such as 45 m.p.h.

As illustrated in FIG. 2, the length of the sleeve 58 is made long enough and spring 56 strong enough so that at speeds up to about 45 m.p.h. the pressure differential across the diphragm 38 is still not great enough to unseat the washers 52 from engagement with the sleeve 58 against the force of spring 56 at speeds up to 45 m.p.h. The end 36*a* of the rod 36 is therefore maintained, by the bias of the spring 56, at the same position as in FIG. 1. However, the suction at the high port increases to cause the pressure differential across the diaphragm 14 to overcome the biasing force of the spring 26 and to push the end 30*b* into contact with the end 36*a*. This limits the movement of the operating arm 22 to the amount of free play between the ends 30*b* and 36*a* as originally set by the adjustable sleeve 34, in this case about three-sixteenths inch. This three-sixteenths inch of travel of the operating arm 22 provides a maximum of about 6° of ignition advance at speeds up to 45 m.p.h. at high intake suctions as the differential fluid pressure on diaphragm 38 increases such differential pressure plus the pressure on diaphragm 14 from the high port may allow an increase in V.S.A. as 45 m.p.h. is approached.

At speeds over 45 m.p.h. the pressure differential across the diaphragm 38 is large enough to move the washers 52 off the sleeve 58 and into engagement with the end 59*a* of the adjustable threaded stop 59. This permits an additional one-eighth inch of axial travel of the operating arm 22 and permits the ignition to advance 11° at speeds above 45 m.p.h. Other advance limits and speed changes can be used if desired for emission and mileage controls.

While the water pump 72, motor 40 and probes 58 and 78 have been illustrated as a specific device for limiting the movement of the stop 30, other speed sensing apparatus can be used. For example, the speed can be sensed from the speedometer cable as shown in FIG. 6, from the transmission as shown in FIG. 7 or from other engine operated accessories such as the ignition system as shown in FIG. 8. In the latter case, the frequency of ignition can be sensed from a sleeve over a single spark plug wire from the distributor and close a switch at a selected speed to operate a solenoid to affect the V.S.A.

The specific water pump speed sensing device illustrated has an advantage of providing a sharp signal at a selected speed of about 45 to 55 m.p.h. or higher. That is, the pressure differential between the pitot opening in probe 78 and probe 68 plots as a curve which has a definite curvature above 1000 RPM of the engine and many speeds can be selected if desired.

The engine speed could also be sensed by a single pitot tube 78 at the periphery of the water pump. However, providing a counteracting pressure from the static pressure probe 68 at the intake compensates for increases in cooling system pressure produced by spring biased pressure caps on the engine radiator.

The water pump speed sensor thus gives good action to move from no motion to full motion on a short increase on RPM at about 45 or 55 m.p.h.

While the operation of the present invention has been described with reference to a specific construction which produces certain ignition advances at certain engine speeds, it will be recognized that the flexibility of control provided by the adjustments of the sleeve 34, the length of the sleeve 56, the bias of the spring 56 and the adjustment of the variable stop 59 permit variation of the settings and facilitate calibration of the device.

Another embodiment of a speed responsive V.S.A. limiter stop is shown in FIGS. 4–7 and is indicated generally by the reference numeral 100.

Figure 3:
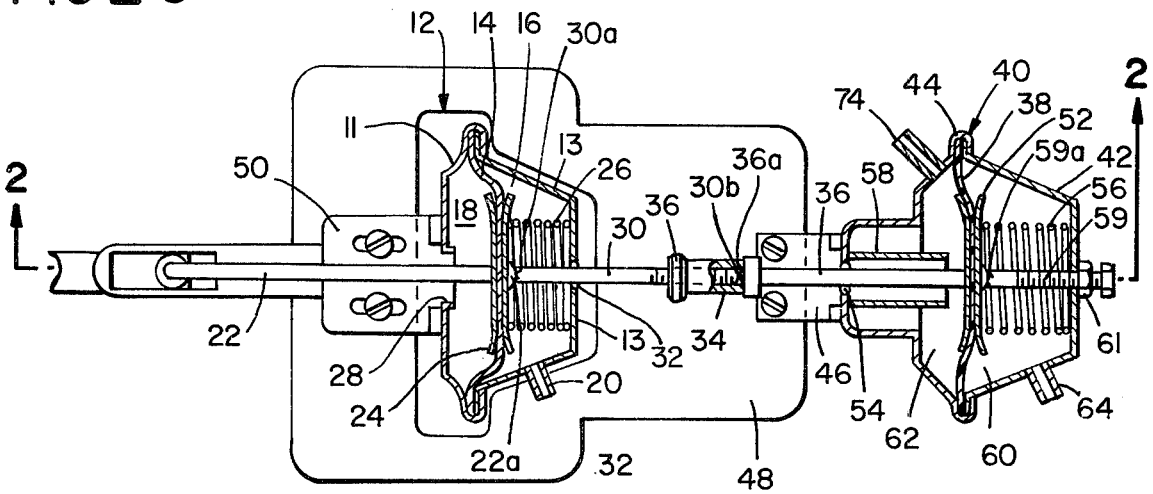
FIG. 3 is a view like FIG. 2 showing the positions of the parts at speeds over a selected speed such as 45 m.p.h. where the speed limit might be 50 or 55 m.p.h.

In the embodiment shown in FIGS. 4–7 parts which correspond to those of the FIGS. 1–3 embodiment are indicated by the same reference numerals.

Figure 4:
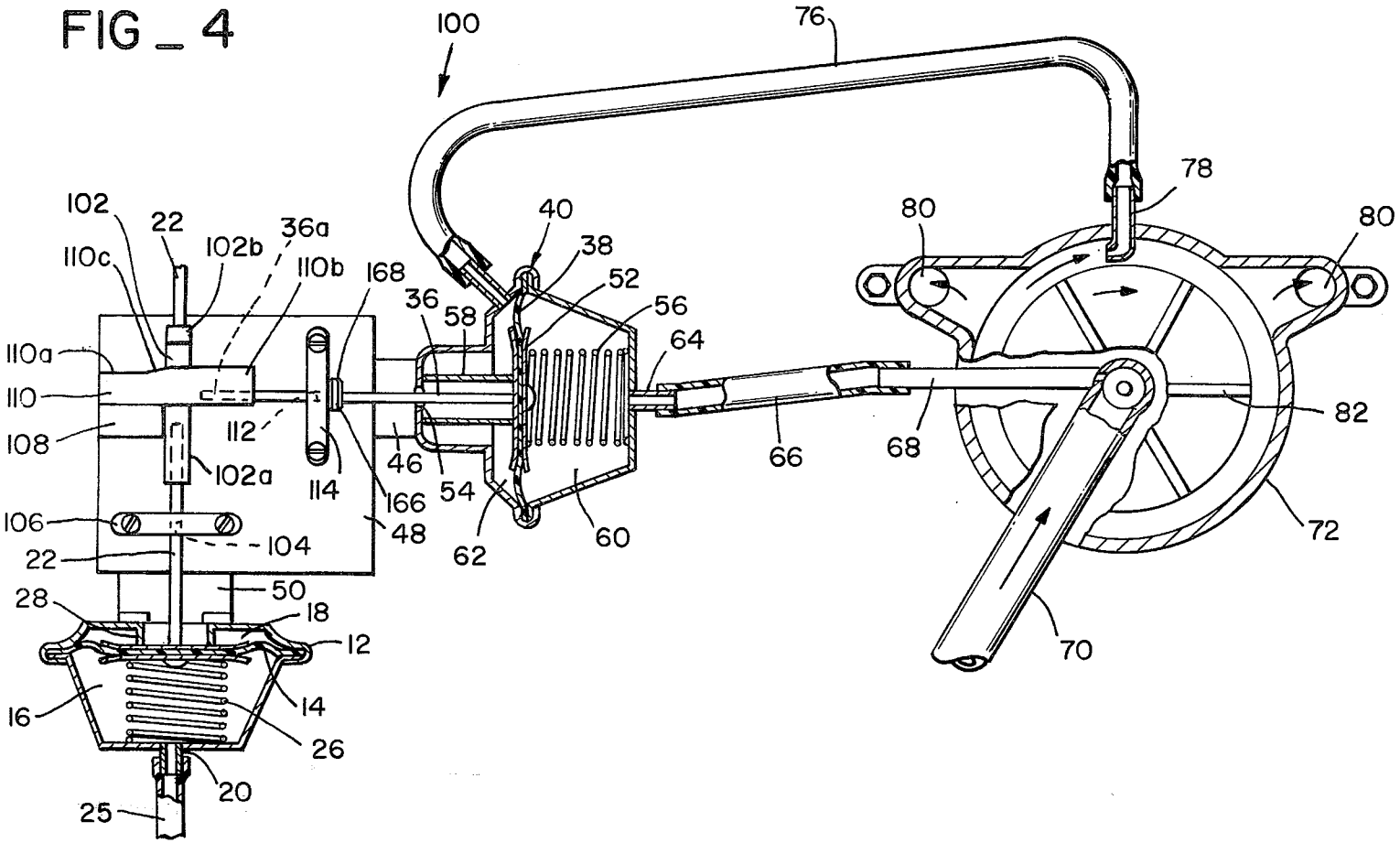
FIG. 4 is a schematic plan view of a second embodiment of the present invention. In the FIG. 4 embodiment the movable stop is a cam member.

In the V.S.A. limiter device 100 shown in FIG. 4 the arm 22 connected to the breaker plate of the distributor has a stop member 102 connected between the section of the arm 22 that goes to the distributor and the section of the arm 22 that is connected to the washers 18 of the flexible diaphragm 14 in the V.S.A. motor 12.

The stop member 102 has a longitudinally extending part 102*a* and an upstanding lug 102*b* which actually serves as the stop element. The part 102*a* is threaded onto the end of the arm 22 that is connected to the washers 18, and the section of the arm 22 that is connected to the distributor is also threaded into or otherwise suitably attached to the member 102.

The section of the arm 22 connected to the washers 18 is mounted for movement in an opening 104 in an upstanding guide member 106 mounted on the baseplate 48.

An additional upstanding guide member 108 provides a guide for the stop member 102. This guide 108 also provides backup support for a cam member 110.

The cam member 110 is movable at right angles with respect to the direction of movement of the arm 22 and is connected to the rod 36 of the speed responsive motor 40. As illustrated in FIG. 4, the cam member 110 is threaded onto the end 36*a* of the rod 36, and the rod 36 is movable within an opening 112 in an upstanding guide member 114. An adjustable stop 166 is connected to the rod 36 on the motor 40 side of the guide 114, and a set screw 168 permits the stop 166 to be clamped in any desired position on this part of the rod 36.

The cam element 110 has a first flat cam surface 110*a* and a second flat cam surface 110*b* joined by sloping cam surface 110*c*.

FIG. 5 illustrates the connection between the fitting 20 of the V.S.A. motor 12 and the high port 21 of the carburetor. The high port 21 is as illustrated, located just above the upstream edge of the throttle butterfly 23 with the butterfly valve in the closed position.

The fitting 20 is connected to the high port 21 by a line 25.

In the operation of the device 100, illustrated in FIG. 4, the parts are shown in FIG. 4 in the positions assumed at engine idle or low engine speed. This corresponds to the disposition of the parts shown in FIG. 1. In this engine idle condition of operation there is not enough suction at the high port to retract the operating arm 22 and there is about one-fourth inch of free travel permitted before the stop element 102*b* contacts the cam face 110*b*.

When the throttle is opened slightly past the high port 21, intake suction increases due to the butterfly passing the high port, and the suction at the high port 21 causes the pressure differential across the diaphragm 14 to retract the arm 22, the stop 102*b* first engages the cam face 110*b*. This limits the ignition advance to the approximately three-sixteenths inch of travel of the arm 22 to restrict the advance to a maximum of 6° at speeds below a selected speed such as 45 m.p.h.

When the engine speed becomes greater than the selected speed such as 45 m.p.h., the differential pressure across the diaphragm 38 moves the washers 52 off the sleeve 58. This retracts the cam element 110 to cause the stop element 102*b* to engage the cam surface 110*a*. This permits about one-eighth inch additional retraction of the operating arm 22 and provides for an ignition advance of 11° at engine speeds above 45 m.p.h., assuming a normal 15° V.S.A. with no stops. This cam eliminates the combined action of diaphragms 38 and 14 acting against springs 56 and 26 as in the construction shown in FIGS. 1, 2 and 3, and may be more desirable in some cases.

On new cars where the V.S.A. motor can be designed for a V.S.A. less than the advance previously provided in some motors, for example, 11° V.S.A. rather than 15° V.S.A., the cam or rod limiter of FIG. 4 or FIG. 1 can then provide a lesser limit on the V.S.A. below a selected engine or car speed (while permitting the full V.S.A. for engine or car speeds above the selected engine or car speed) for the same basic advantages in emissions and miles per gallon.

To those skilled in the art to which this invention relates, many changes in construction and widely differing embodiments and applications of the invention will suggest themselves without departing from the spirit and scope of the invention. The disclosures and the description herein are purely illustrative and are not intended to be in any sense limiting.

I claim:

1. In a vacuum spark advance mechanism for an internal combustion engine of the kind in which an operating element of an intake suction operated spark advance motor is connected to an electrical interrupter mechanism controlling some of the timing of the ignition advance or retard and is normally movable to a maximum vacuum spark advance position by high engine intake suction from the engine when transmitted past control valves, the improvement comprising, limiting means for limiting the movement of the operating element to an amount less than said normal maximum vacuum spark advance position while still permitting a substantial vacuum controlled spark advance, speed responsive means associated with the limiting means for changing the limit on the movement in response to a selected change in engine or vehicle speed to permit a greater amount of movement above the selected speed then below the selected speed, said limiting means including a mechanical stop element having first and second stop surfaces for engaging the operating element to limit movement of the operating element, and positioning means associated with the speed responsive means and effective at speeds below said selected speed to locate the first stop surface in an operating position where the first stop surface can engage the operating element and effective at speeds above said selected speed to move the first stop surface from said operating position and to locate the second stop surface in said operating position.

2. The invention defined in claim 1 wherein the speed responsive means include differential pressures sensed from within the cooling liquid pump at different speeds of rotation of the engine and the cooling liquid pump.

3. The invention defined in claim 1 wherein the speed responsive means are associated with the speedometer cable.

4. The invention defined in claim 1 wherein the speed responsive means are associated with the automobile transmission.

5. The invention defined in claim 1 wherein the speed responsive means are sensed by a portion of the ignition system of the engine.

6. The invention defined in claim 1 wherein the mechanical stop element is a cam member and includes a sloping cam surface interconnecting the first and second cam surfaces.

7. The invention defined in claim 6 wherein said first and second stop surfaces on said cam member offer two different travel limits available to said operating element in said suction operated spark advance motor, each less than the travel limits available in said suction operated spark advance motor.

* * * * *